US006281459B1

(12) United States Patent
Munsch et al.

(10) Patent No.: US 6,281,459 B1
(45) Date of Patent: Aug. 28, 2001

(54) CIRCUIT INTERRUPTER HAVING AN IMPROVED SLOT MOTOR ASSEMBLY

(75) Inventors: William David Munsch, Pittsburgh; Richard Paul Malingowski, Finleyville; Craig Allen Rodgers, Butler; Ronald William Brand, Jr., Beaver Falls; Lois Ann Gill, Aliquippa, all of PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/556,925

(22) Filed: Apr. 21, 2000

(51) Int. Cl.[7] ..... H01H 33/18
(52) U.S. Cl. ..... 218/22; 335/16; 335/147
(58) Field of Search ..... 335/6, 16, 147, 335/195, 202; 218/22; 200/293–308

(56) References Cited

U.S. PATENT DOCUMENTS 4,743,720 * 5/1988 Takeuchi et al. ..... 218/22
4,963,849 * 10/1990 Kowalczyk et al. ..... 335/201
5,223,681 * 6/1993 Buehler et al. ..... 218/22
5,910,760 * 6/1999 Malingowski et al. ..... 335/167

* cited by examiner

*Primary Examiner*—Lincoln Donovan
*Assistant Examiner*—Tuyen T. Nguyen
(74) *Attorney, Agent, or Firm*—Charles E. Kosinski

(57) ABSTRACT

A circuit interrupter including a housing, separable main contacts within the housing, and an operating mechanism within the housing and interconnected with the contacts. An arc extinguisher assembly is disposed within the housing. Also provided within the housing is a slot motor assembly having a cavity region within which the contacts are substantially located. The slot motor assembly electromagnetically interacts with current flowing between the contacts, and includes magnetic plates positioned in a slot motor housing. The slot motor housing has a tendency to move an arc existing between the contacts toward the arc extinguisher assembly. The slot motor assembly also includes an insulation member positioned within the cavity region and between the magnetic plates and the slot motor housing.

13 Claims, 14 Drawing Sheets

OFF POSITION

ON POSITION

TRIPPED POSITION

CIRCUIT INTERRUPTER HAVING AN IMPROVED SLOT MOTOR ASSEMBLY

BACKGROUND OF THE INVENTION

1. Field of the Invention

The present invention relates to circuit interrupters generally and, more specifically, to those kinds of circuit interrupters having a slot motor assembly for enabling an electromagnetic blow-open operation to be generated.

2. Description of the Prior Art

Molded case circuit breakers and interrupters are well known in the art as exemplified by U.S. Pat. No. 4,503,408 issued Mar. 5, 1985, to Mrenna et al., and U.S. Pat. 5,910,760 issued Jun. 8, 1999 to Malingowski, et al, each of which is assigned to the assignee of the present application and incorporated herein by reference.

It is known to implement an arc extinguisher assembly within a circuit breaker, the function of which is to receive and dissipate electrical arcs that are created upon separation of the breaker's contacts. Commonly, such an arc extinguisher assembly includes an arc chute within which are positioned spaced-apart arc chute plates.

It is also known to implement a slot motor assembly within a circuit breaker in order to provide a faster separation of its contacts than can normally occur as the result of a typical tripping operation. The current flowing between the contacts induces a magnetic field into a closed magnetic loop provided by magnetic plates of the slot motor assembly. This magnetic field electro-magnetically interacts with the current in such a manner as to have a tendency to move the moveable contact arm in the opening direction. The higher the magnitude of the current, the stronger the magnetic interaction. For very high current (an overcurrent condition), the above process provides a blow-open operation in which the moveable contact arm independently and forcefully rotates upwardly and separates the contacts.

The housing of the slot motor assembly is typically molded, and may be formed of a material that evolves gas upon interaction with an electrical arc. The evolved gas helps move the arc toward the arc chute and flatten it against the arc chute plates in the form of a band or ribbon. This shape makes it easier to split the arc and move it into the arc chute where it is dissipated.

Unfortunately, the housing of the slot motor assembly sometimes is thinned and can become porous due to the ablating of the gas-evolving material during arcing events. In the prior art, the potential thinned and porous areas of the housing can allow ionized gas or the arc itself to pass through to the magnetic plates which, undesirably, can create an electrical short. In addition, gas-evolving materials used for the housing typically have less-than-desirable molding properties, such as brittleness and high warpage, which make it difficult to mold the housing into a form providing sufficient protection to the magnetic plates.

It would be advantageous if a circuit breaker existed having a slot motor assembly that was cost-effective and easily manufactured and that prevented ionized gas from passing through potential thinned or porous areas of the assembly's housing. It would also be advantageous if a circuit breaker existed having a slot motor assembly that enabled a more easily molded assembly housing to be implemented.

SUMMARY OF THE INVENTION

The present invention provides a circuit interrupter that meets all of the above-identified needs.

In accordance with the present invention, a circuit interrupter is provided which includes a housing, separable main contacts within the housing, and an operating mechanism within the housing and interconnected with the separable main contacts. An arc extinguisher assembly is disposed within the housing. Also provided within the housing is a slot motor assembly having a cavity region within which the separable main contacts are substantially located. The slot motor assembly electro-magnetically interacts with current flowing between the contacts, and includes magnetic plates positioned in a slot motor housing. The slot motor housing has a tendency to move an arc existing between the contacts toward the arc extinguisher assembly. The slot motor assembly also includes an insulation member positioned within the cavity region and between the magnetic plates and the slot motor housing.

This and other objects and advantages of the present invention will become apparent from a reading of the following description of the preferred embodiment taken in connection with the attached drawings.

DESCRIPTION OF THE PREFERRED EMBODIMENT

Figure 1:
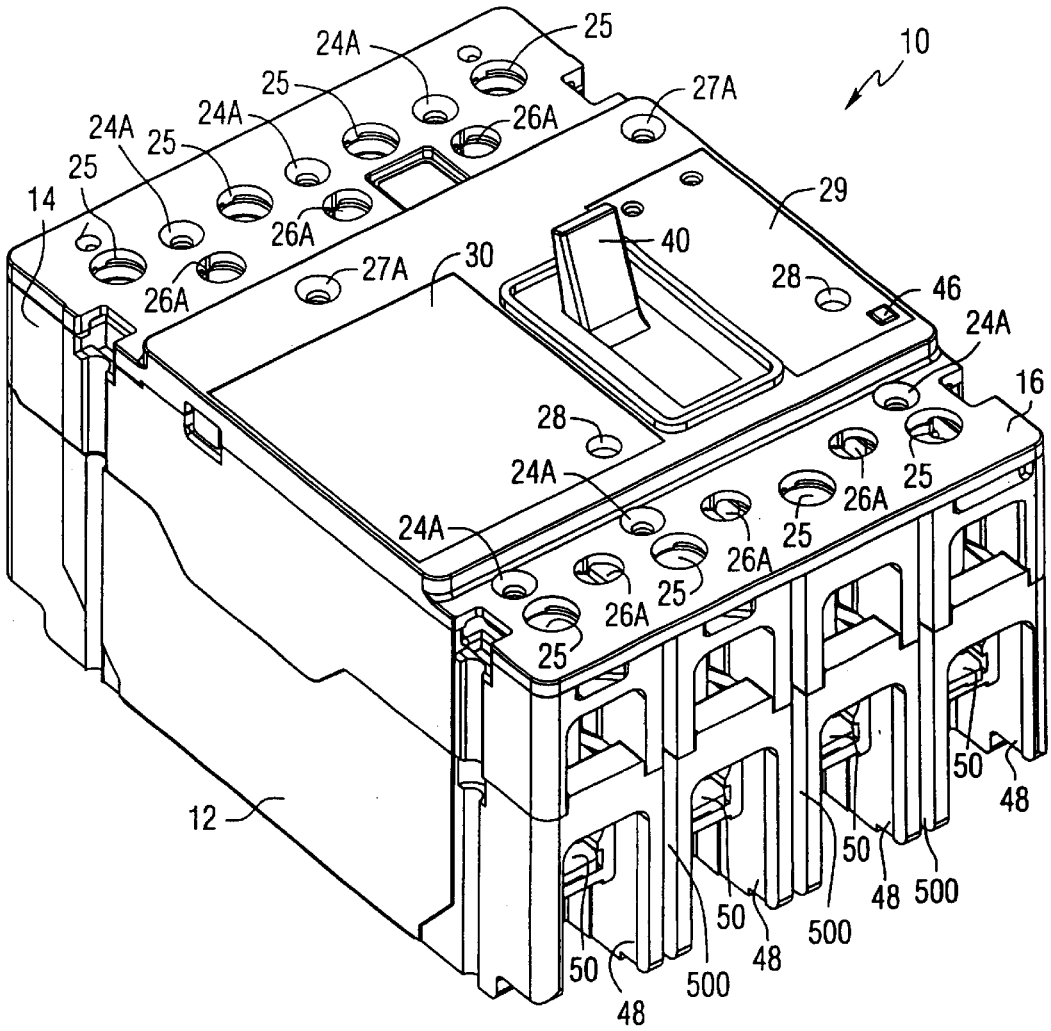
FIG. 1 is an orthogonal view of a molded case circuit interrupter embodying the present invention.
Figure 2:
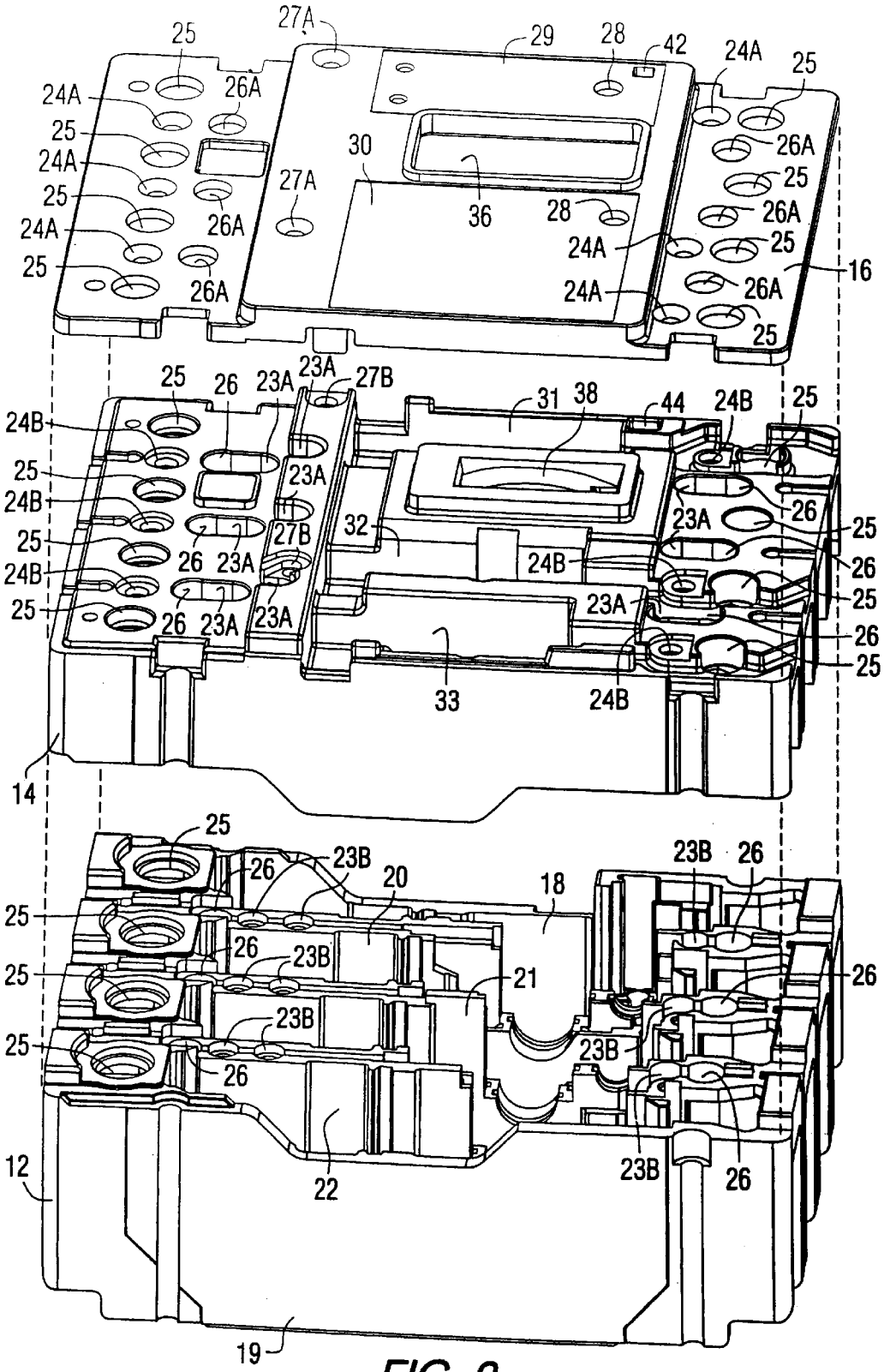
FIG. 2 is an exploded view of the base, primary cover, and secondary cover of the circuit interrupter of FIG. 1.

Referring now to the drawings and FIGS. 1 and 2 in particular, shown is a molded case circuit interrupter or breaker 10. Circuit breaker 10 includes a base 12 mechanically interconnected with a primary cover 14. Disposed on top of primary cover 14 is an auxiliary or secondary cover 16. When removed, secondary cover 16 renders some internal portions of the circuit breaker available for maintenance and the like without requiring disassembly of the entire circuit breaker. Base 12 includes outside sidewalls 18 and 19, and internal phase walls 20, 21, and 22. Holes or openings 23A are provided in primary cover 14 for accepting screws or other attaching devices that enter corresponding holes or openings 23B in base 12 for fastening primary cover 14 to base 12. Holes or openings 24A are provided in secondary cover 16 for accepting screws or other attaching devices that enter corresponding holes or openings 24B in primary cover 14 for fastening secondary cover 16 to primary cover 14. Holes 27A in secondary cover 16 and corresponding holes 27B in primary cover 14 are for attachment of external accessories as described below. Holes 28 are also for attachment of external accessories (only to secondary cover 16) as described below. Holes 25, which feed through secondary cover 16, primary cover 14, and into base 12 (one side showing holes 25), are provided for access to electrical terminal areas of circuit breaker 10. Holes 26A, which feed through secondary cover 16, correspond to holes 26 that feed through primary cover 14 and base 12, and are provided for attaching the entire circuit breaker assembly onto a wall, or into a DIN rail back panel or a load center, or the like. Surfaces 29 and 30 of secondary cover 16 are for placement of labels onto circuit breaker 10. Primary cover 14 includes cavities 31, 32, and 33 for placement of internal accessories of circuit breaker 10. Secondary cover 16 includes a secondary cover handle opening 36. Primary cover 14 includes a primary cover handle opening 38. A handle 40 (FIG. 1) protrudes through openings 36 and 38 and is used in a conventional manner to manually open and close the contacts of circuit breaker 10 and to reset circuit breaker 10 when it is in a tripped state. Handle 40 may also provide an indication of the status of circuit breaker 10 whereby the position of handle 40 corresponds with a legend (not shown) on secondary cover 16 near handle opening 36 which clearly indicates whether circuit breaker 10 is ON (contacts closed), OFF (contacts open), or TRIPPED (contacts open due to, for example, an overcurrent condition). Secondary cover 16 and primary cover 14 include rectangular openings 42 and 44, respectively, through which protrudes a top portion 46 (FIG. 1) of a button for a push-to-trip actuator. Also shown are load conductor openings 48 in base 12 that shield and protect load terminals 50. Although circuit breaker 10 is depicted as a four phase circuit breaker, the present invention is not limited to four-phase operation.

Figure 3:
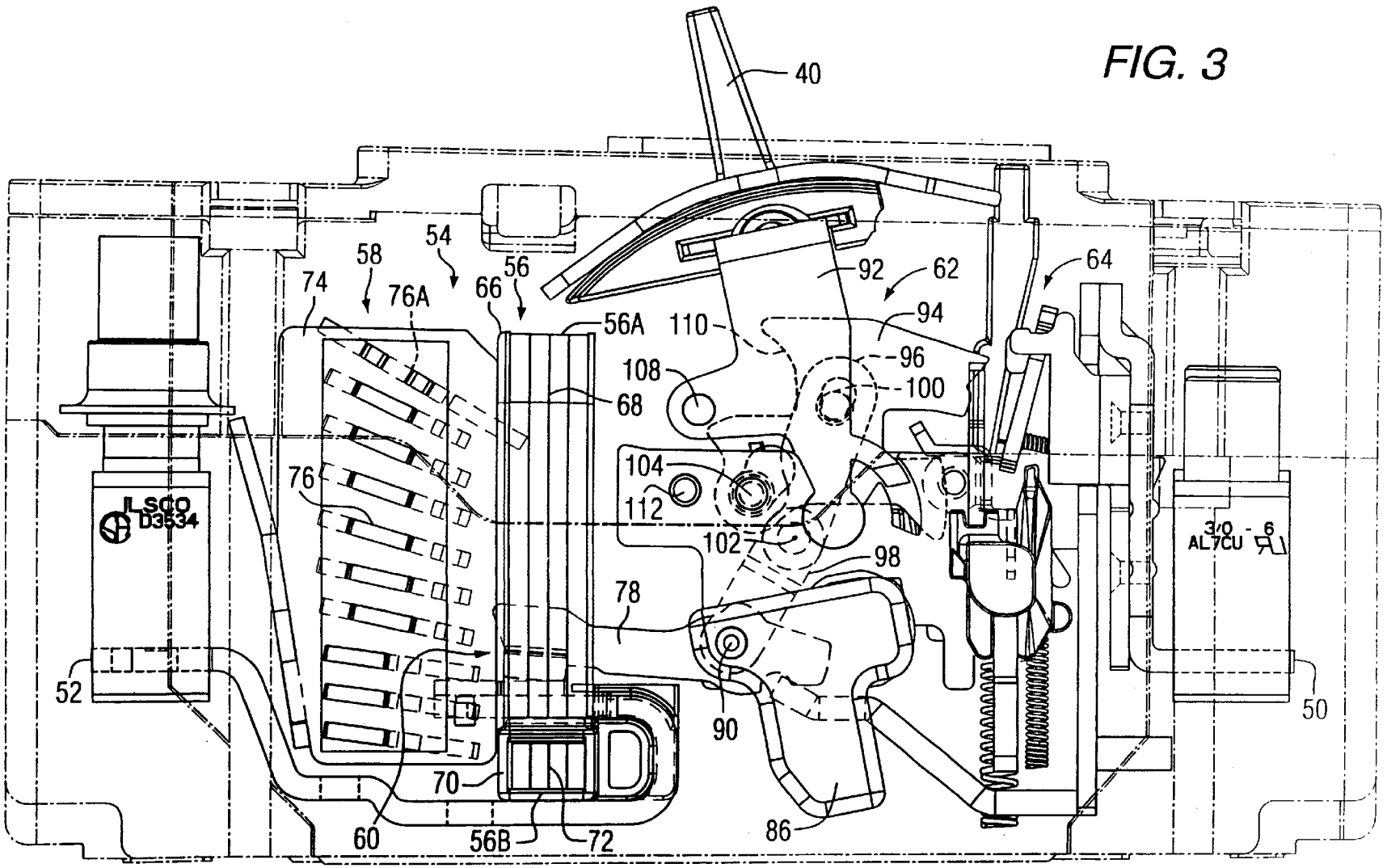
FIG. 3 is a side elevational view of an internal portion of the circuit interrupter of FIG. 1.

Referring now to FIG. 3, a longitudinal section of a side elevation, partially broken away and partially in phantom, of circuit breaker 10 is shown having a load terminal 50 and a line terminal 52. There is shown a plasma arc acceleration chamber 54 comprising a slot motor assembly 56 and an arc extinguisher assembly 58. Also shown is a contact assembly 60, an operating mechanism 62, and a trip mechanism 64. Although not viewable in FIG. 3, each phase of circuit breaker 10 has its own load terminal 50, line terminal 52, plasma arc acceleration chamber 54, slot motor assembly 56, arc extinguisher assembly 58, and contact assembly 60, as shown and described below. Reference is often made herein to only one such group of components and their constituents for the sake of simplicity.

Figure 4:
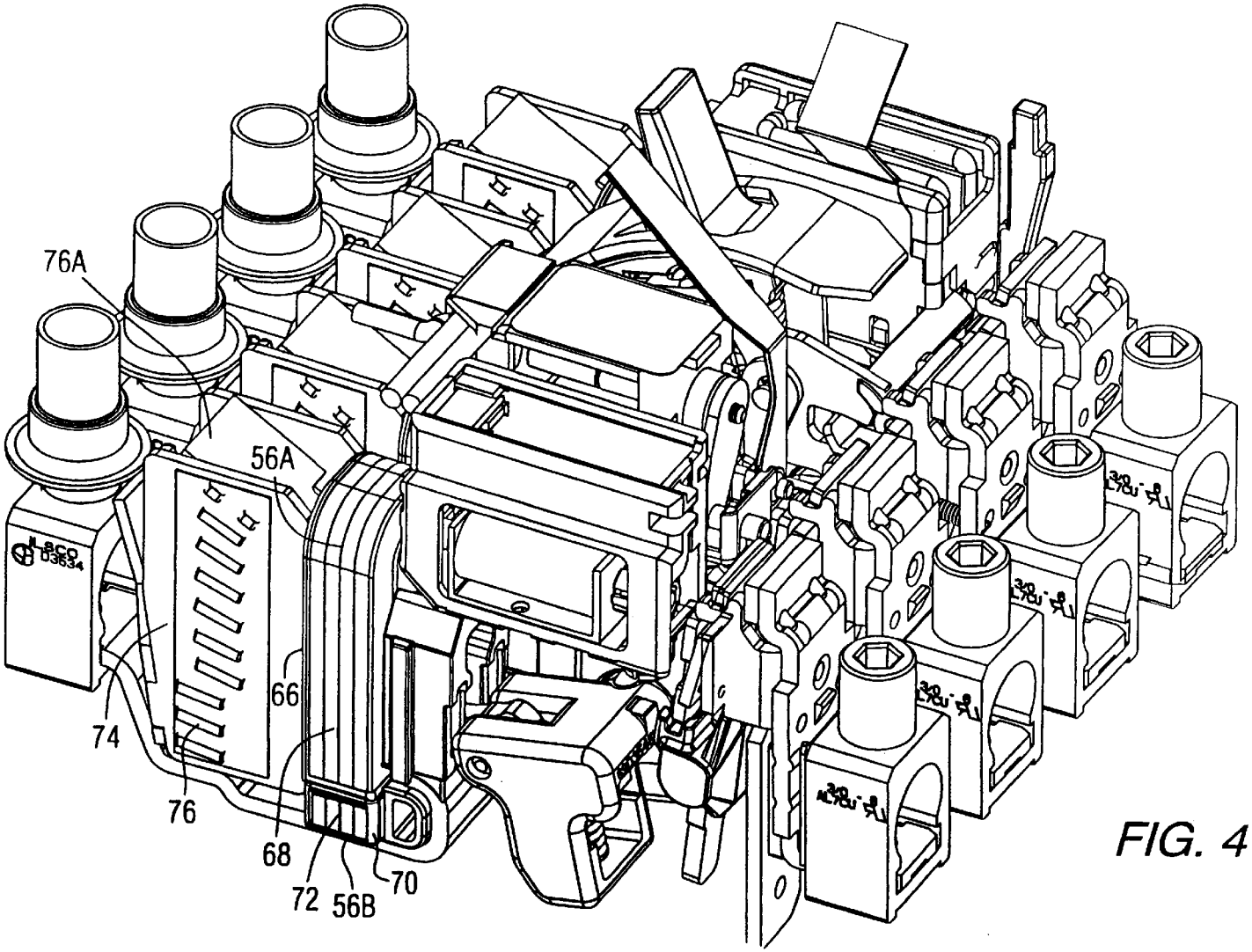
FIG. 4 is an orthogonal view of the internal portions of the circuit interrupter of FIG. 1 without the base and covers.

Referring again to FIG. 3, and now also to FIG. 4 which shows a side elevational view of the internal workings of circuit breaker 10 without base 12 and covers 14 and 16, each slot motor assembly 56 is shown as including a separate upper slot motor assembly 56A and a separate lower slot motor assembly 56B. Upper slot motor assembly 56A includes an upper slot motor assembly housing 66 within which are stacked side-by-side U-shaped upper slot motor assembly plates 68. Similarly, lower slot motor assembly 56B includes a lower slot motor assembly housing 70 within which are stacked side-by-side lower slot motor assembly plates 72. Plates 68 and 72 are both composed of magnetic material, and are steel, approximately .072 inch thick plates in the exemplary embodiment.

Each arc extinguisher assembly 58 includes an arc chute 74 within which are positioned spaced-apart generally parallel angularly offset arc chute plates 76 and an upper arc runner 76A. As known to one of ordinary skill in the art, the function of arc extinguisher assembly 58 is to receive and dissipate electrical arcs that are created upon separation of the contacts of the circuit breaker.

Figure 5:
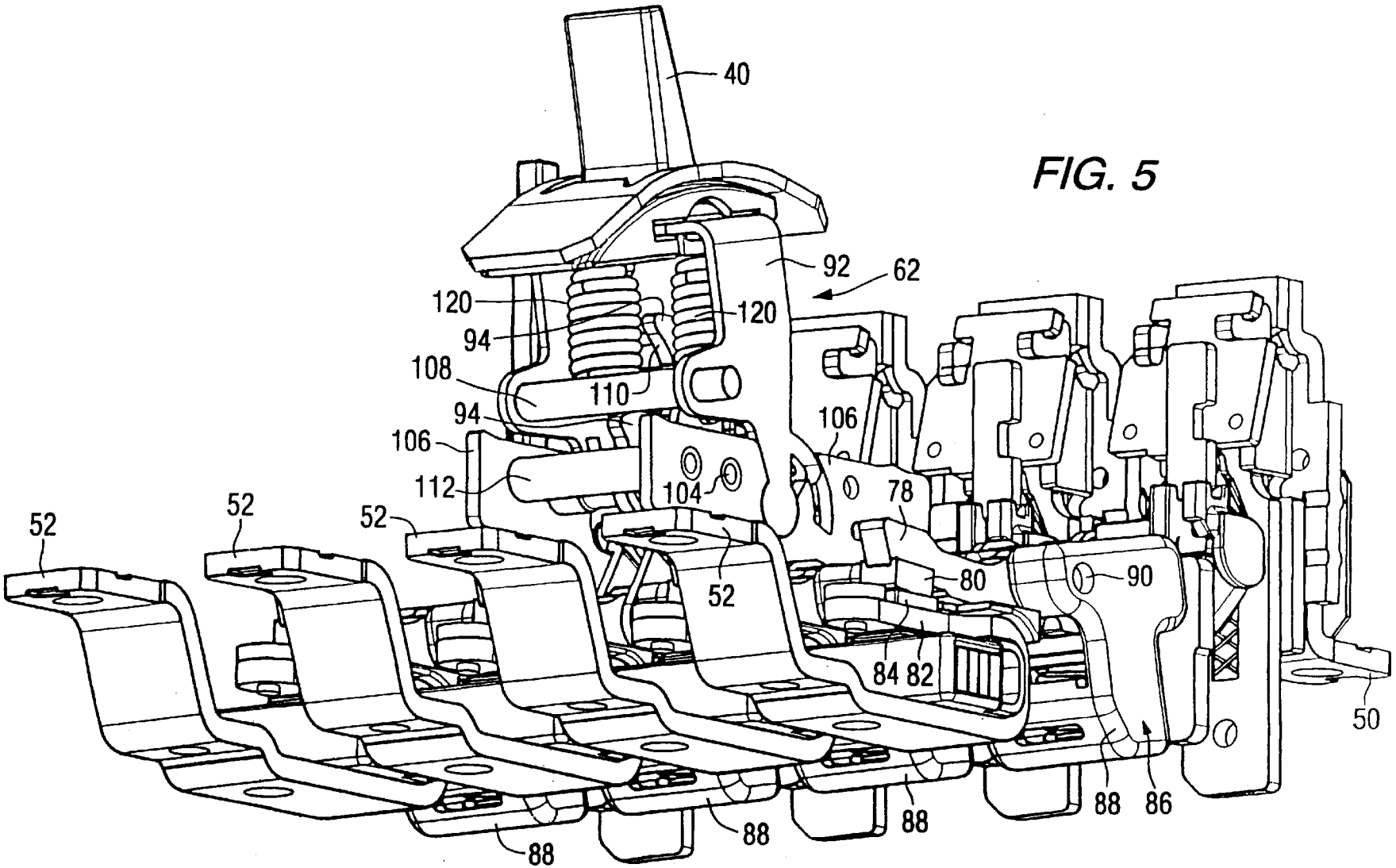
FIG. 5 is an orthogonal view of an internal portion of the circuit interrupter of FIG. 1 including the operating mechanism.

Referring now to FIG. 5, shown is an orthogonal view of an internal portion of circuit breaker 10. Each contact assembly 60 (FIG. 3) is shown as comprising a movable contact arm 78 supporting thereon a movable contact 80, and a stationary contact arm 82 supporting thereon a stationary contact 84. Each stationary contact arm 82 is electrically connected to a line terminal 52 and, although not shown, each movable contact arm 78 is electrically connected to a load terminal 50. Also shown is a crossbar assembly 86 which traverses the width of circuit breaker 10 and is rotatably disposed on an internal portion of base 12 (not shown). Actuation of operating mechanism 62, in a manner described in detail below, causes crossbar assembly 86 and movable contact arms 78 to rotate into or out of a disposition which places movable contacts 80 into or out of a disposition of electrical continuity with fixed contacts 84. Crossbar assembly 86 includes a movable contact cam housing 88 for each movable contact arm 78. A pivot pin 90 is disposed in each housing 88 upon which a movable contact arm 78 is rotatably disposed. Under normal circumstances, movable contact arms 78 rotate in unison with the rotation of crossbar assembly 86 (and housings 88) as crossbar assembly 86 is rotated clockwise or counter-clockwise by action of operating mechanism 62. However, it is to be noted that each movable contact arm 78 is free to rotate (within limits) independently of the rotation of crossbar assembly 86. In particular, in certain dynamic, electromagnetic situations, each movable contact arm 78 can rotate upwardly about pivot pin 90 under the influence of high magnetic forces. This is referred to as "blow-open" operation, and is described in greater detail below.

Continuing to refer to FIG. 5 and again to FIG. 3, operating mechanism 62 is shown. Operating mechanism 62 is structurally and functionally similar to that shown and described in U.S. Pat. No. 5,910,760 issued Jun. 8, 1999 to Malingowski, et al., entitled "Circuit Breaker with Double Rate Spring" and U.S. patent application Ser. No. 09/384,139, filed Aug. 27, 1999, entitled "Circuit Interrupter With A Trip Mechanism Having Improved Spring Biasing", both disclosures of which are incorporated herein by reference. Operating mechanism 62 comprises a handle arm or handle assembly 92 (connected to handle 40), a configured plate or cradle 94, an upper toggle link 96, an interlinked lower toggle link 98, and an upper toggle link pivot pin 100 which interlinks upper toggle link 96 with cradle 94. Lower toggle link 98 is pivotally interconnected with upper toggle link 96 by way of an intermediate toggle link pivot pin 102, and with crossbar assembly 86 at pivot pin 90. Provided is a cradle pivot pin 104 which is laterally and rotatably disposed between parallel, spaced apart operating mechanism support members or sideplates 106. Cradle 94 is free to rotate (within limits) via cradle pivot pin 104. Also provided is a handle assembly roller 108 which is disposed in and supported by handle assembly 92 in such a manner as to make mechanical contact with (roll against) arcuate portions of a back region 110 of cradle 94 during a "resetting" operation of circuit breaker 10. A main stop bar 112 is laterally disposed between sideplates 106, and provides a limit to the counter-clockwise movement of cradle 94.

Figure 6:
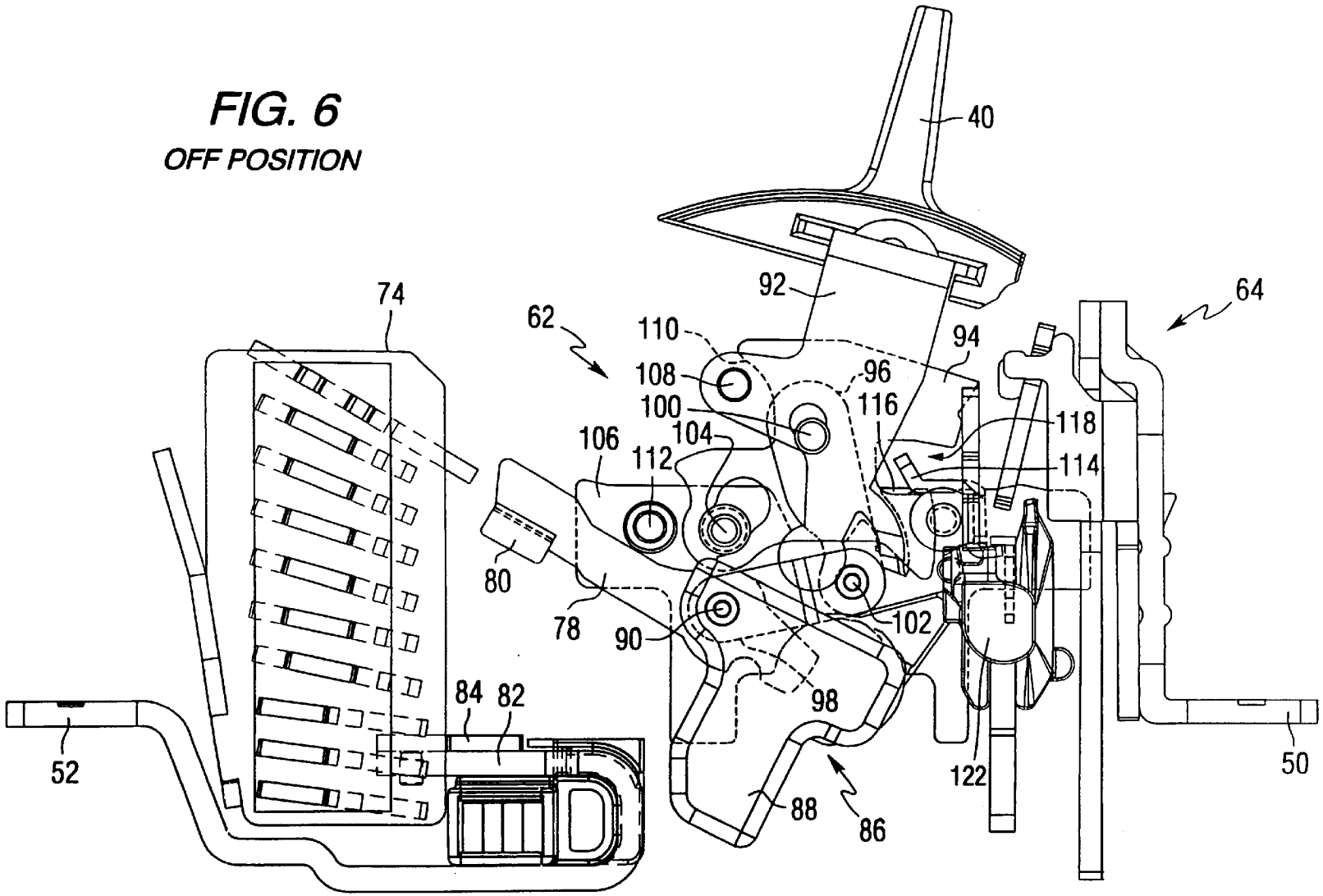
FIG. 6 is a side elevational, partially broken away view of the operating mechanism of the circuit interrupter of FIG. 1 with the contacts and the handle in the OFF disposition.

Referring now to FIG. 6, an elevation of that part of circuit breaker 10 particularly associated with operating mechanism 62 is shown for the OFF disposition of circuit breaker 10. Upper slot motor assembly 56A is not shown for the sake of clarity. Contacts 80 and 84 are shown in the disconnected or open disposition. An intermediate latch 114 is shown in its latched position wherein it abuts hard against a lower portion 116 of a latch cutout region 118 of cradle 94. A pair of side-by-side aligned compression springs 120 (FIG. 5) such as shown in U.S. Pat. No. 4,503,408 is disposed between the top portion of handle assembly 92 and the intermediate toggle link pivot pin 102. The tension in springs 120 has a tendency to load lower portion 116 of cradle 94 against the intermediate latch 114. In the OPEN disposition shown in FIG. 6, latch 114 is prevented from unlatching cradle 94, notwithstanding the spring tension, because the other end thereof is fixed in place by a rotatable trip bar assembly 122 of trip mechanism 64. Trip bar assembly 122 is spring-biased in the counter-clockwise rotational direction against the intermediate latch 114. This is the standard latch arrangement found in all dispositions of circuit breaker 10 except the TRIPPED disposition which is described below.

Figure 7:
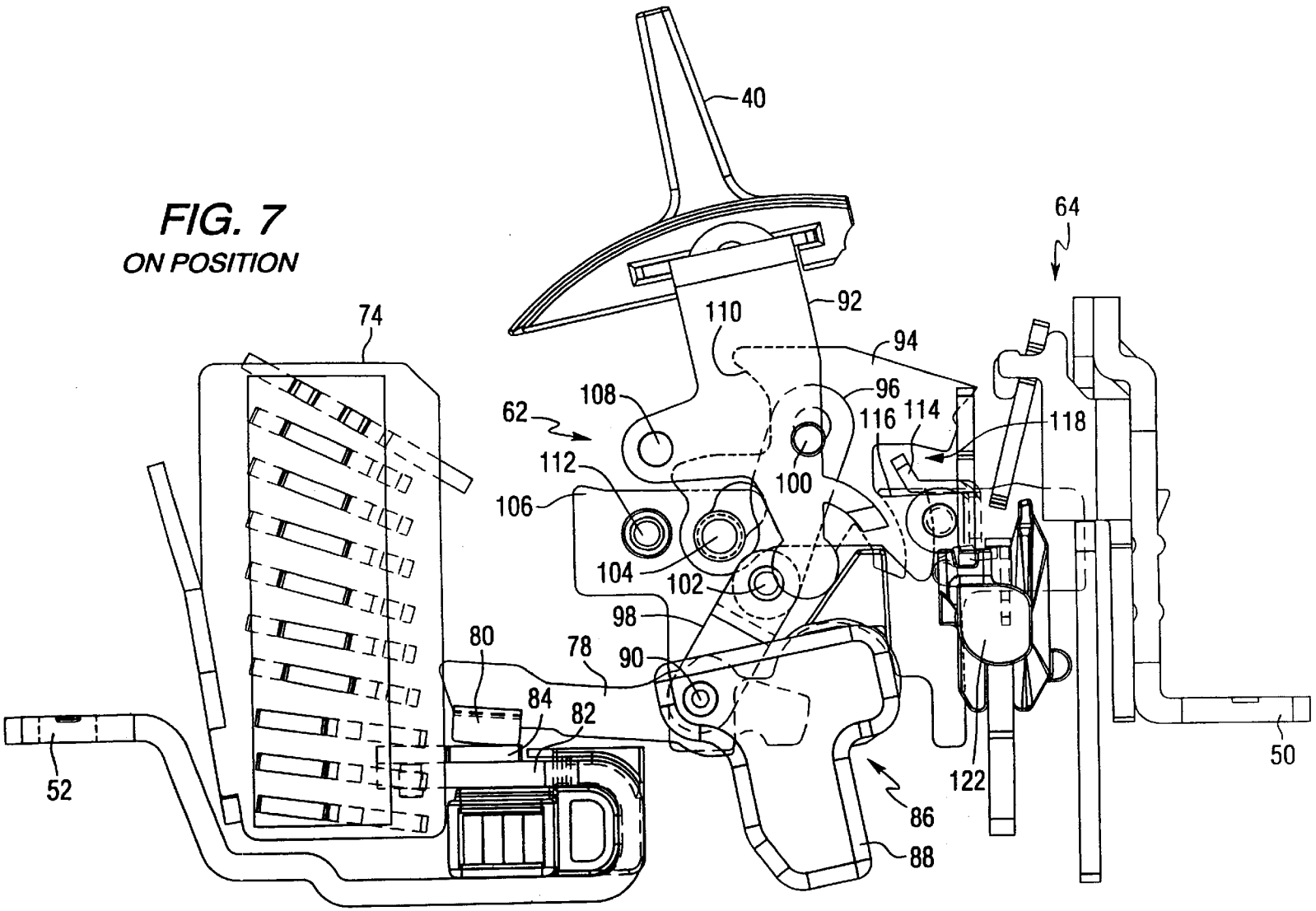
FIG. 7 is a side elevational, partially broken away view of the operating mechanism with the contacts and the handle in the ON disposition.

Referring now to FIG. 7, operating mechanism 62 is shown for the ON disposition of circuit breaker 10. In this disposition, contacts 80 and 84 are closed (in contact with each other) whereby electrical current may flow from load terminals 50 to line terminals 52. In order to achieve the ON disposition, handle 40, and thus fixedly attached handle assembly 92, are rotated in a counter-clockwise direction (to the left) thus causing the intermediate toggle link pivot pin 102 to be influenced by the tension springs 120 (FIG. 5) attached thereto and to the top of handle assembly 92. The influence of springs 120 causes upper toggle link 96 and lower toggle link 98 to assume the position shown in FIG. 7 which causes the pivotal interconnection with crossbar assembly 86 at pivot point 90 to rotate crossbar assembly 86 in the counter-clockwise direction. This rotation of crossbar assembly 86 causes movable contact arms 78 to rotate in the counter30 clockwise direction and ultimately force movable contacts 80 into a pressurized abutted disposition with stationary contacts 84. It is to be noted that cradle 94 remains latched by intermediate latch 114 as influenced by trip mechanism 64.

Figure 8:
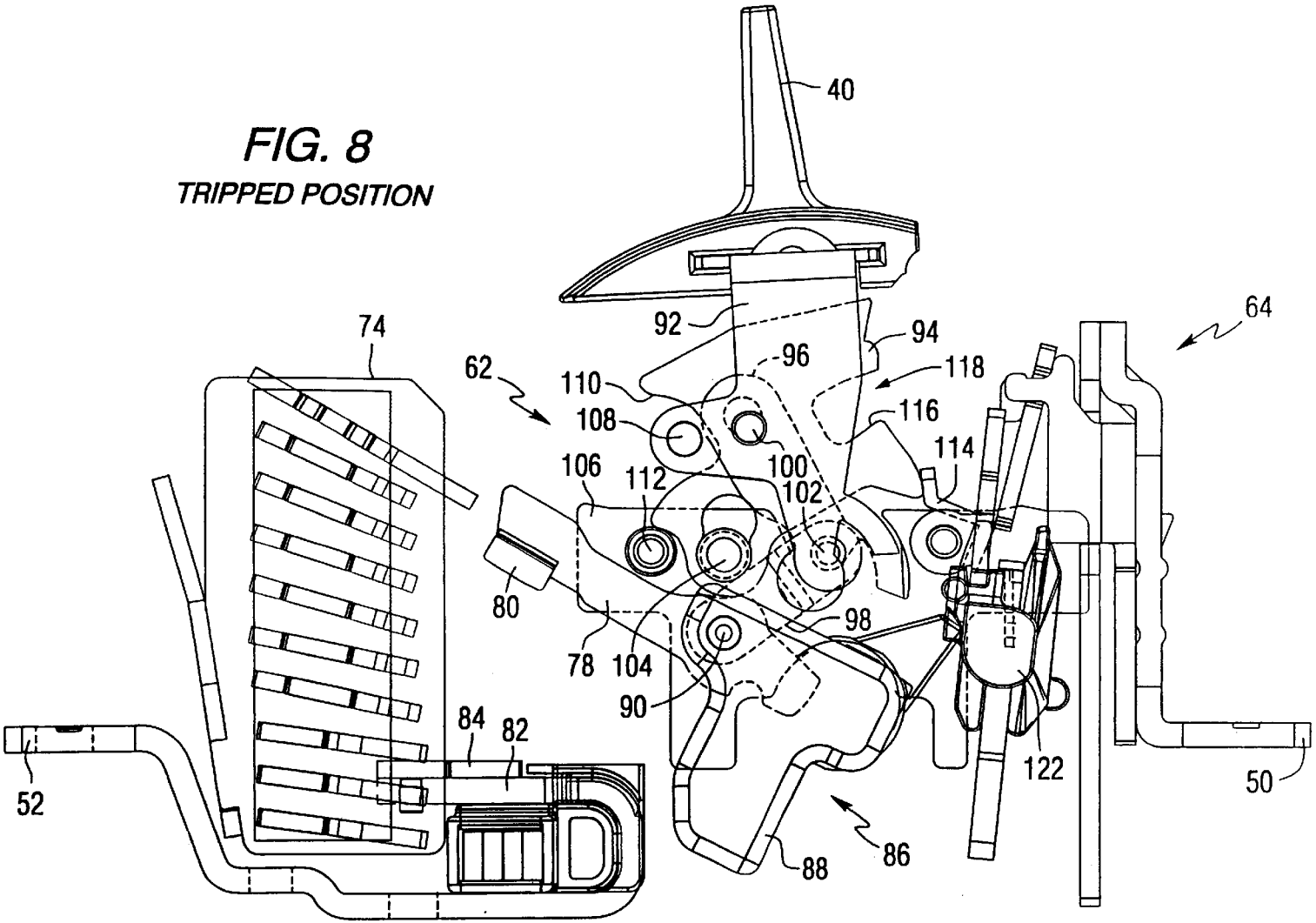
FIG. 8 is a side elevational, partially broken away view of the operating mechanism with the contacts and the handle in the TRIPPED disposition.

Referring now to FIG. 8, operating mechanism 62 is shown for the TRIPPED disposition of circuit breaker 10. The TRIPPED disposition is related (except when a manual tripping operation is performed) to an automatic opening of circuit breaker 10 caused by, for example, the thermally or magnetically induced reaction of trip mechanism 64 to the magnitude of the current flowing between load conductors 50 and line conductors 52. A detailed description of such tripping operations and of the operation of trip mechanism 64 can be found in U.S. patent application Ser. No. 09/386,126, filed Aug. 30, 1999, entitled "Circuit Interrupter With Trip Bar Assembly Having Improved Biasing", the disclosure of which is incorporated herein by reference. Whatever the nature of a tripping operation, it is initiated by a force causing trip bar assembly 122 to rotate clockwise (overcoming the spring force biasing assembly 122 in the opposite direction) and away from intermediate latch 114. This unlocking of latch 114 releases cradle 94 (which had been held in place at lower portion 116 of latch cutout region 118) and enables it to be rotated counter-clockwise under the influence of tension springs 120 (FIG. 5) interacting between the top of handle assembly 92 and the intermediate toggle link pivot pin 102. The resulting collapse of the toggle arrangement causes pivot pin 90 to be rotated clockwise and upwardly to thus cause crossbar assembly 86 to similarly rotate. This rotation of crossbar assembly 86 causes a clockwise motion of movable contact arms 78, resulting in a separation of contacts 80 and 84. The above sequence of events results in handle 40 being placed into an intermediate disposition between its OFF disposition (as shown in FIG. 6) and its ON disposition (as shown in FIG. 7). Once in this TRIPPED disposition, circuit breaker 10 can not again achieve the ON disposition (contacts 80 and 84 closed) until it is first "reset" via a resetting operation which is described in U.S. patent application Ser. No. 09/386,126.

Figure 9:
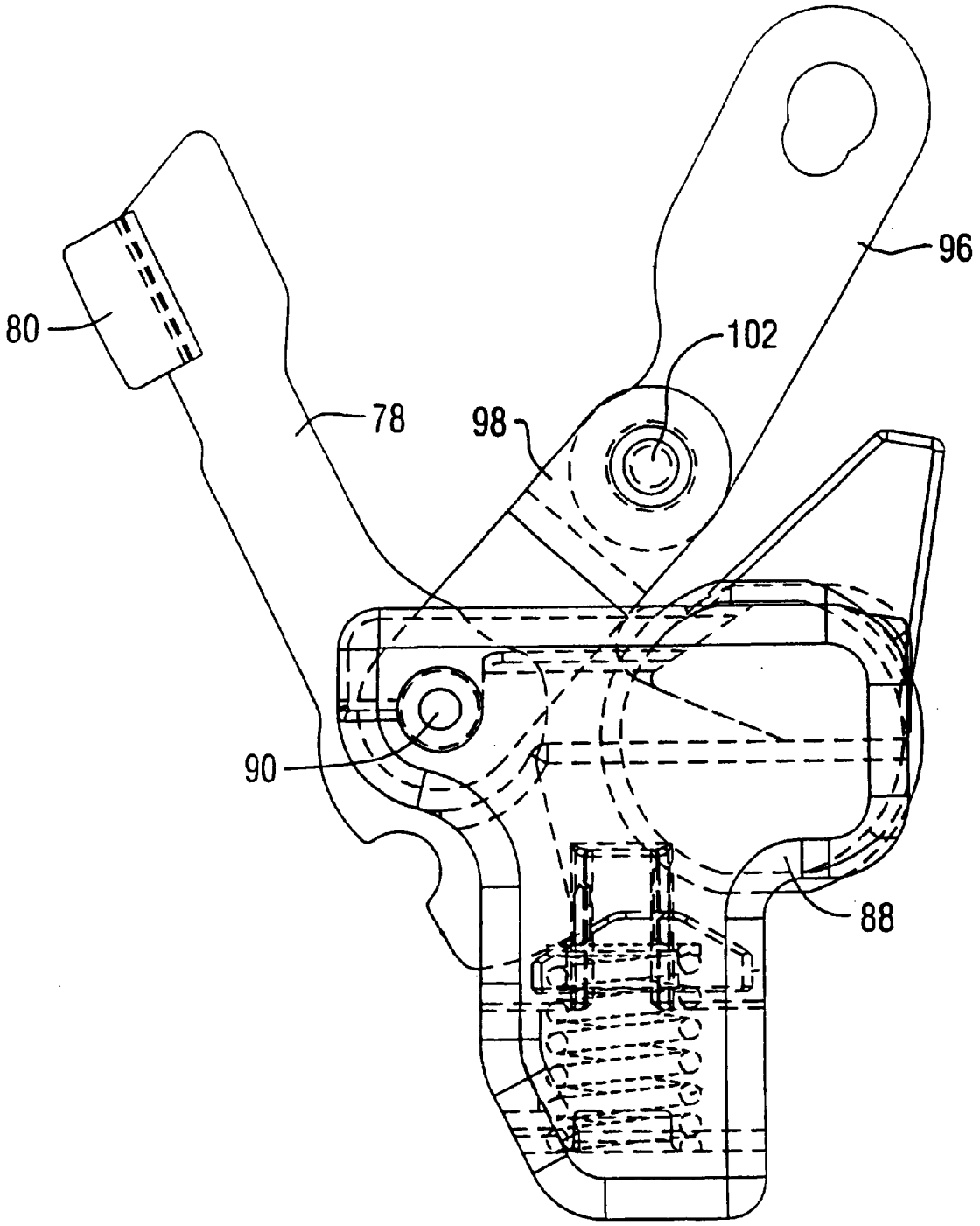
FIG. 9 is a side elevational, partially broken away view showing the relative positions of a crossbar assembly and a moveable contact arm after a blow-open operation.

Referring again to FIGS. 3, 4, and 5, and now also to FIG. 9, upper slot motor assembly 56A and lower slot motor assembly 56B are functionally similar to that described in U.S. Pat. No. 5,910,760 issued Jun. 8, 1999 to Malingowski et al., and plates 68 and 72 thereof form an essentially closed electromagnetic path in the vicinity of contacts 80 and 84. At the beginning of a contact opening operation, electrical current continues to flow in a movable contact arm 78 and through an electrical arc created between contacts 80 and 84. This current induces a magnetic field into the closed magnetic loop provided by upper plates 68 and lower plates 72 of upper slot motor assembly 56A and lower slot motor assembly 56B, respectively. This magnetic field electromagnetically interacts with the current in such a manner as to accelerate the movement of the movable contact arm 78 in the opening direction whereby contacts 80 and 84 are more rapidly separated. The higher the magnitude of the electrical current flowing in the arc, the stronger the magnetic interaction and the more quickly contacts 80 and 84 separate. For very high current (an overcurrent condition), the above process provides the blow-open operation described above in which the movable contact arm 78 forcefully rotates upwardly about pivot pin 90 and separates contacts 80 and 84, this rotation being independent of crossbar assembly 86 (as shown in FIG. 9). This blow-open operation is generally shown and described in U.S. Pat. No. 3,815,059 issued Jun. 4, 1974, to Spoelman and incorporated herein by reference, and provides a faster separation of contacts 80 and 84 than can normally occur as the result of a tripping operation generated by trip mechanism 64 as described above in connection with FIG. 8.

Figure 10B:
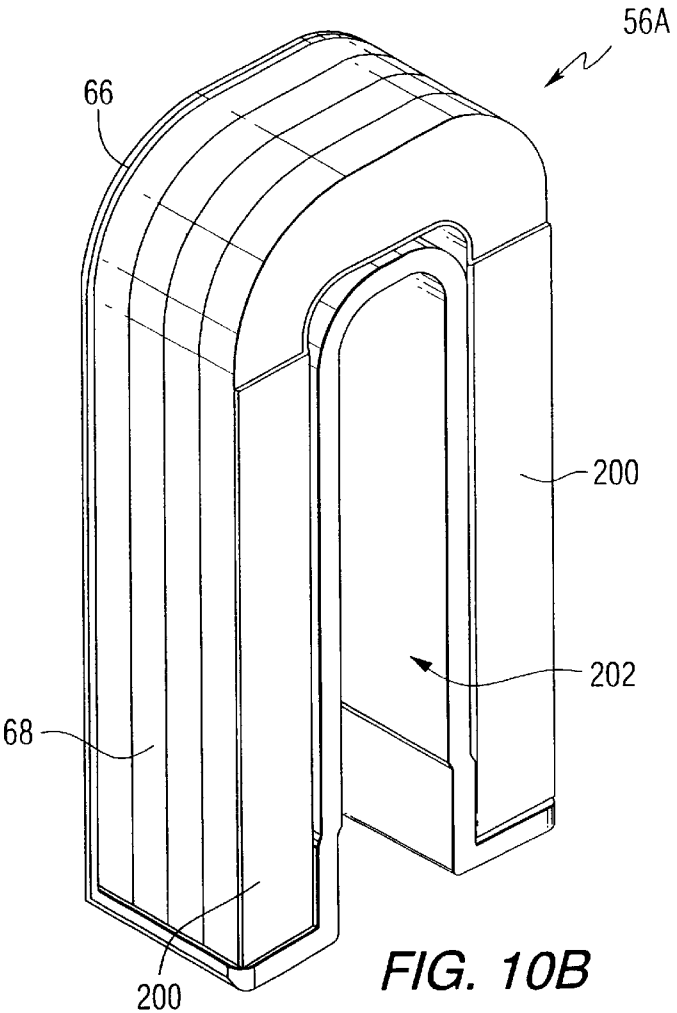
FIGS. 10A and 10B are orthogonal views of the upper slot motor assembly of the circuit interrupter of FIG. 1.
Figure 10A:
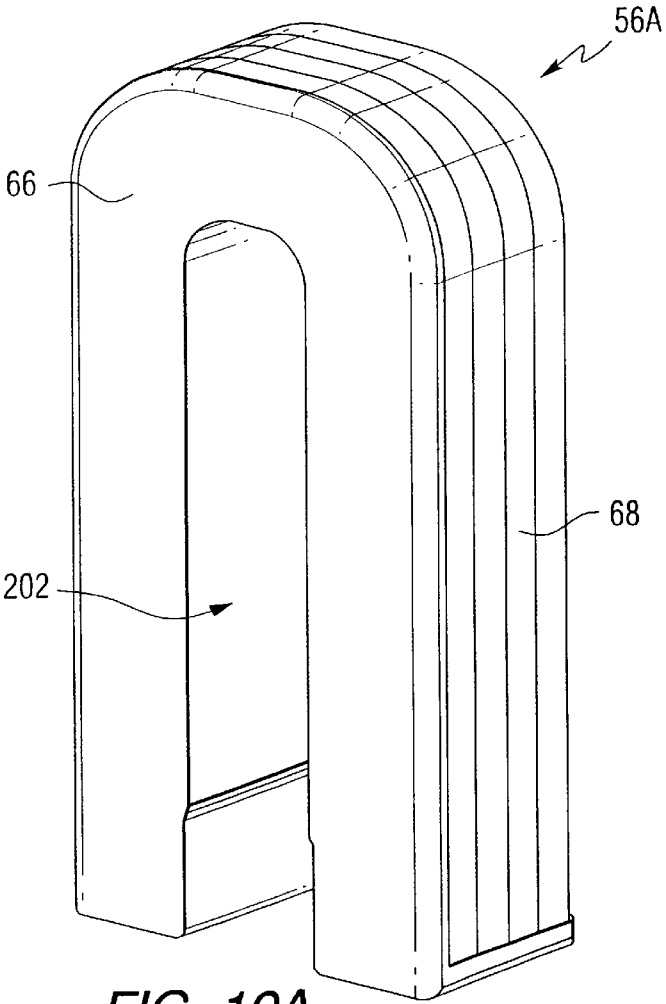

Referring now to FIGS. 10A and 10B, shown is upper slot motor assembly 56A of the present invention comprised of molded housing 66 within which are stacked side-by-side U-shaped plates or laminations 68. Assembly 56A also includes, as described in detail below, an insulation member 200. Assembly 56A defines a substantially rectangular opening or cavity region 202 which provides clearance for pivotal movement of moveable contact arm 78 and moveable contact 80.

Figure 11B:
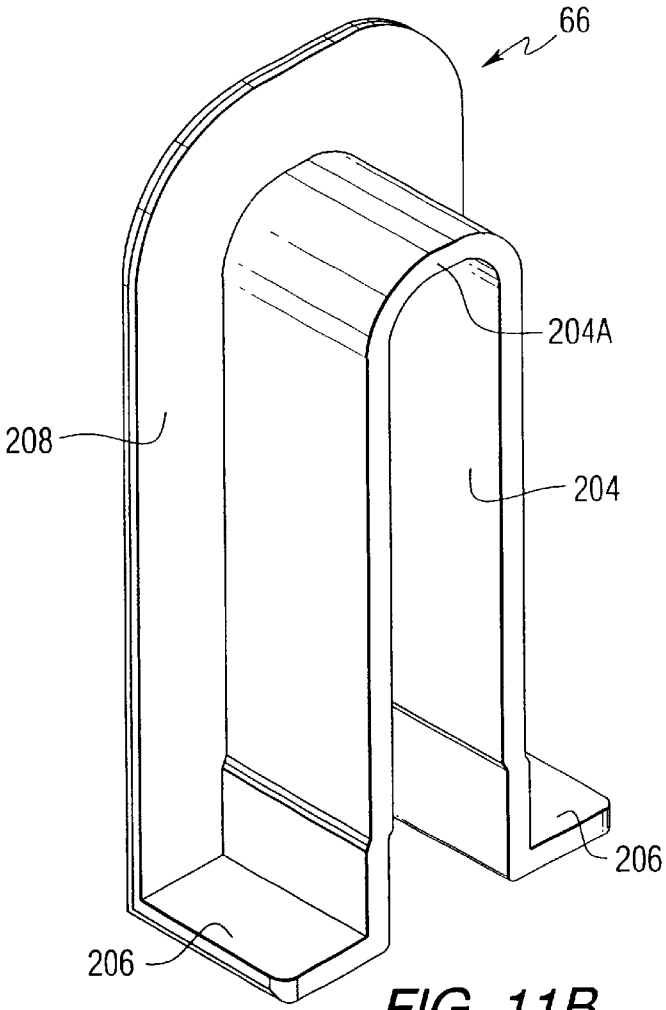
FIGS. 11A and 11B are orthogonal views of the housing of the upper slot motor assembly shown in FIGS. 10A and 10B.
Figure 11A:
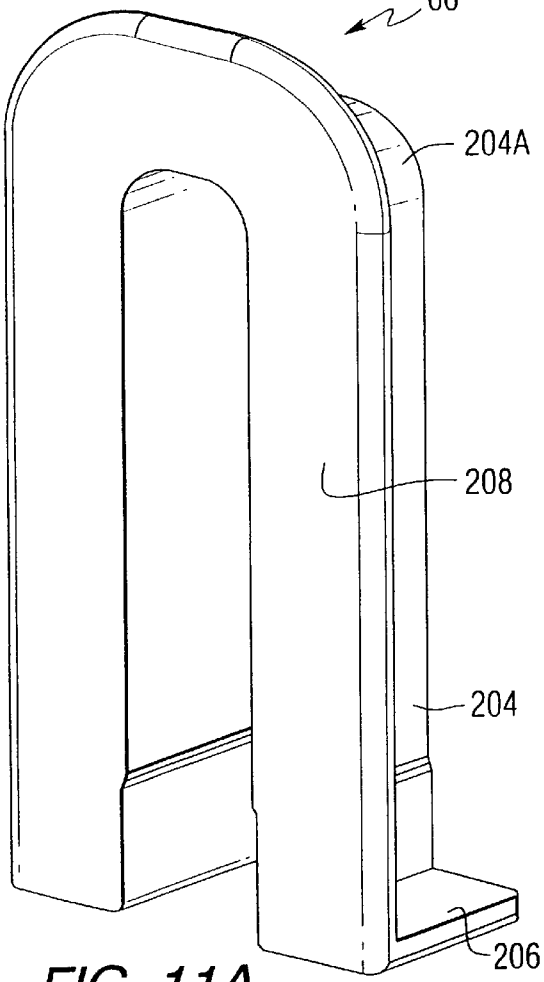
Figure 12:
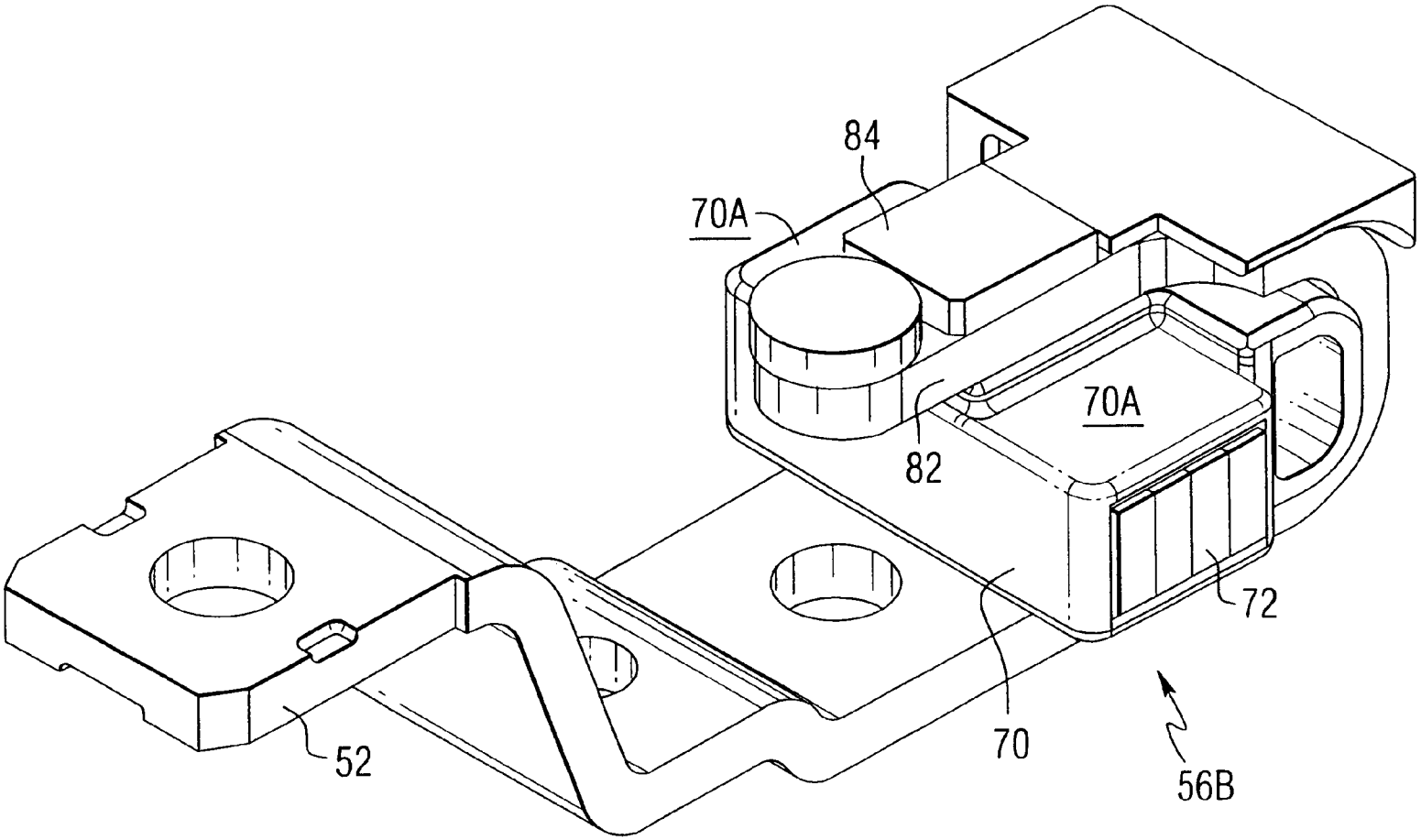
FIG. 12 is an orthogonal view of a portion of the circuit interrupter of FIG. 1 including the lower slot motor assembly.

Referring now to FIGS. 11A and 11B, shown is molded housing 66 of upper slot motor assembly 56A. Housing 66 includes a substantially U-shaped member or mandrel 204 connected to feet 206 and a plate or barrier 208. Mandrel 204 includes a curved top portion 204A. In the exemplary embodiment, housing 66 is molded of a gas-evolving material such as cellulose filled Melamine Formaldehyde, and has a thickness of approximately .038 inches. Referring briefly now also to FIG. 12, shown is a portion of circuit breaker 10 including line terminal 52, stationary contact arm 82, stationary contact 84, and lower slot motor assembly 56B within which are stacked magnetic plates 72. In an assembled circuit breaker 10 as shown in FIG. 3, feet 206 of housing 66 of upper slot motor assembly 56A are positioned on top of surfaces 70A of lower slot motor assembly housing 70 whereby stationary contact 84 is straddled.

Figure 13B:
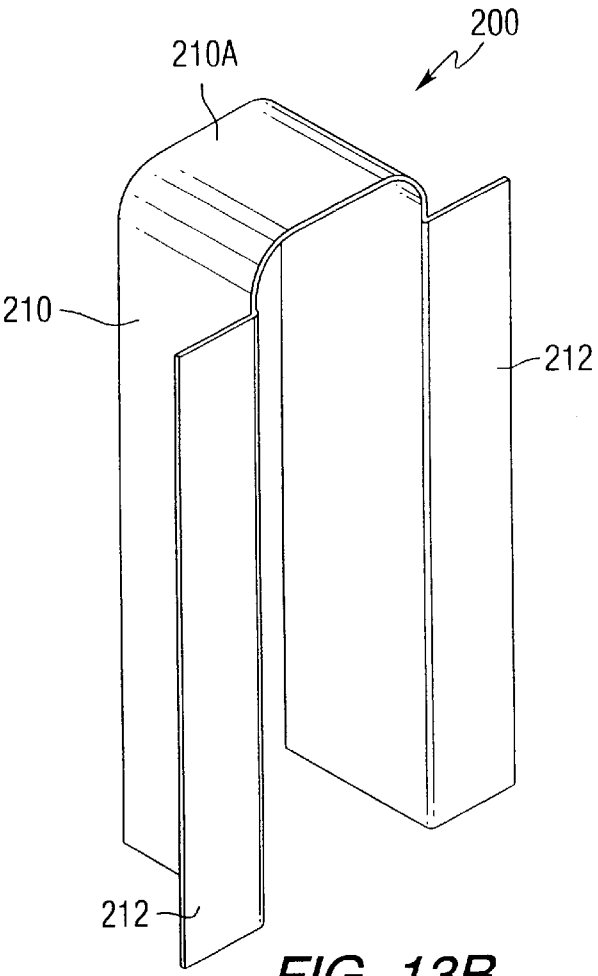
FIGS. 13A and 13B are orthogonal views of the insulation member of the upper slot motor assembly shown in FIGS. 10A and 10B.
Figure 13A:
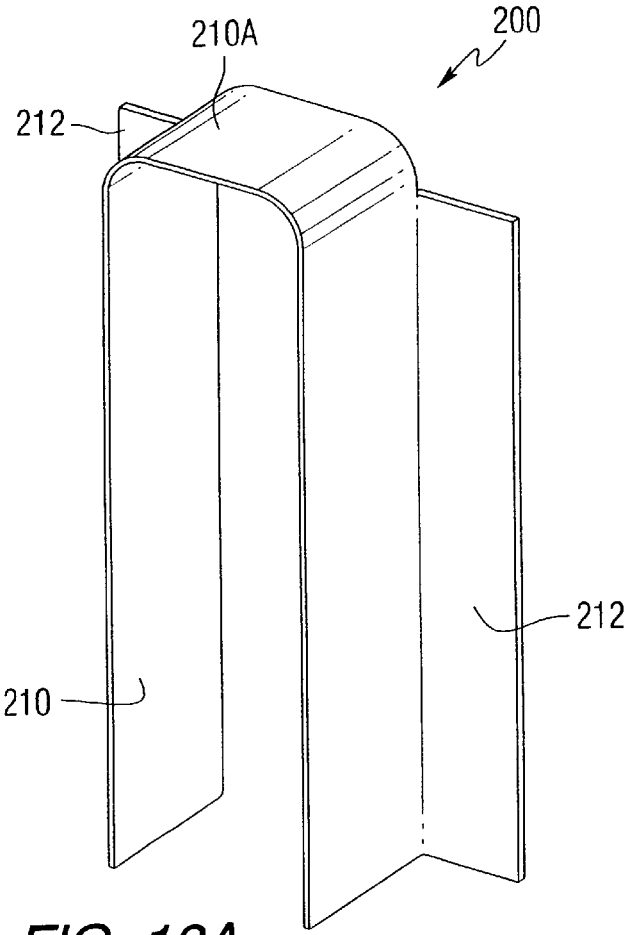

Referring now to FIGS. 13A and 13B, shown is insulation member 200 of upper slot motor assembly 56A. Member 200 includes a substantially U-shaped element 210 from which extends two rectangular flaps 212. Element 210 includes a curved top portion 210A. In the exemplary embodiment, insulation member 200 is an adhesive tape formed of glass-cloth-woven and silicon-resin-treated material of approximately 0.007 inches thick and which can be purchased under the following trademarked names: Permacel P-212, Scotch 69, and Flourglas 2915. This material is substantially gas impervious and substantially arc-resistant (i.e., substantially not affected by exposure to electrical arcs).

Figure 14:
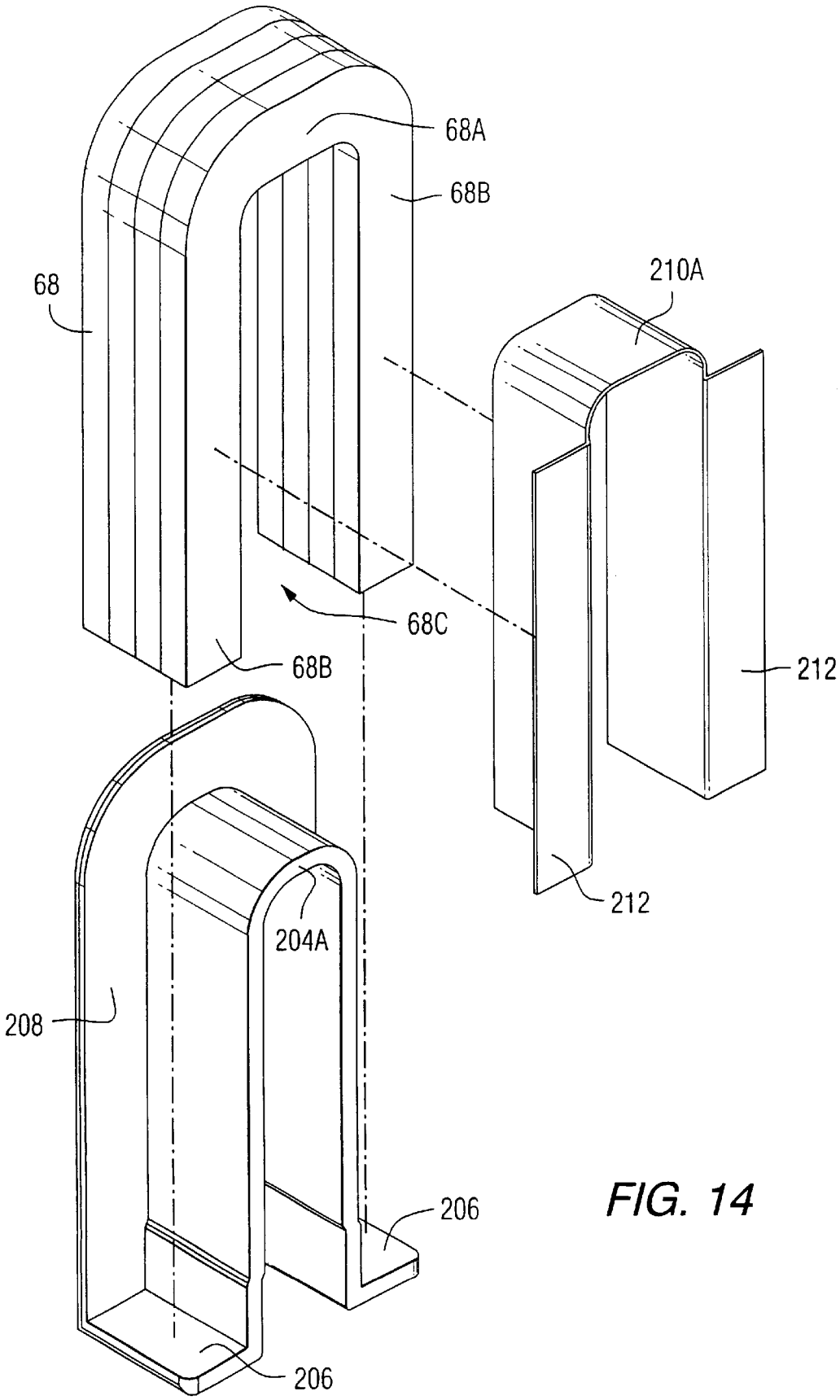
FIG. 14 is an orthogonal view showing the manner of assembly of the upper slot motor assembly shown in FIGS. 10A and 10B.

Referring now also to FIG. 14 and again to FIGS. 10A and 10B, shown is the manner of assembly of upper slot motor assembly 56A. U-shaped plates or laminations 68 are appropriately sized and configured such that U-shaped element 210 of insulation member 200 can be inserted into the aligned grouping of plates 68 whereby it covers (or "lines") the internal surfaces of plates 68 which define the rectangular cavity 68C, with curved top portion 210A beneath arch 68A. With member 200 positioned as such, flaps 212 substantially cover leg surfaces 68B of plates 68 below arch 68A. The combination of plates 68 and insulation member 200 is then positioned on top of housing 66 whereby the legs of plates 68 straddle mandrel 204 and contact feet 206 of housing 66, resulting in an assembled upper slot motor assembly 56A as shown in FIGS. 10A and 10B. In assembly 56A, U-shaped element 210 of insulation member 200 is sandwiched between mandrel 204 of housing 66 and the internal surfaces of plates 68 which define cavity 68C. In addition, plates 68 are supported on one side by barrier 208 of housing 66, as shown in FIGS. 10A and 10B.

In operation, with upper slot motor assembly 56A in an assembled circuit breaker 10 as shown in FIG. 3, an electrical arc existing between contacts 80 and 84 may interact with the gas evolving material of housing 66 of assembly 56A and thereby cause ionized gas to be evolved. The gas has a tendency to move the arc toward arc chute 74 and flatten it against arc chute plates 76 in the form of a band or ribbon, making the arc easier to split whereby it can move into arc chute 74 and be dissipated. During such an arcing event, portions of housing 66 can become ablated, potentially resulting in those areas becoming thinned and/or porous. U-shaped element 210 of insulation member 200 is sandwiched between plates 68 and mandrel 204 of housing 66, the portion of housing 66 most likely to interact with an arc and, therefore, most likely to be ablated. Positioned as such, element 210 prevents ionized gas or the arc itself from passing through any thinned or porous areas in mandrel 204 and causing an electrical short with plates 68. Barrier 208 of housing 66, in a position where it is less likely to be subject to interaction with an arc and, therefore, to ablating than mandrel 204, acts to prevent ionized gas or the arc itself from reaching the side of plates 68 opposite of leg surfaces 68B. Flaps 212 of insulation member 200 act to prevent ionized gas or the arc itself from reaching leg surfaces 68B of plates 68 (albeit less chance of that being a concern due to the positioning of surfaces 68B in relation to contacts 80 and 84). With flaps 212 positioned as such, housing 66 need not have a barrier for protecting leg surfaces 68B similar to barrier 208, thereby enabling a less complex and therefore more easily molded housing 66 to be implemented.

Although the position of barrier 208 makes it less likely to be subject to interaction with an arc and, therefore, to ablating than mandrel 204, insulation member 200 can be modified, in an alternative embodiment, so as to include an additional set of flaps 212 that could be sandwiched between barrier 208 and plates 68 so as to provide another layer of protection as is the case with respect to mandrel 204.

Although the preferred embodiment of the present invention has been described with a certain degree of particularity, various changes to form and detail may be made without departing from the spirit and scope of the invention as hereinafter claimed.

What is claimed is:

1. A circuit interrupter comprising:

a housing;

separable main contacts within said housing;

an operating mechanism within said housing and interconnected with said separable main contacts;

an arc extinguisher assembly within said housing; and a slot motor assembly positioned within said housing and having an opening region in which said separable main contacts are substantially located, said slot motor assembly electro-magnetically interacting with current flowing between said contacts, said slot motor assembly including a magnetic member and a slot motor housing, said slot motor housing positioned between said magnetic member and said opening region, said slot motor housing formed of a material that evolves gas upon exposure to an arc to assist in dissipation of said arc by said arc extinguisher assembly, said slot motor assembly also including an insulation member positioned between said magnetic member and said slot motor housing, said insulation member formed of a material that does not substantial evolve gas upon exposure to an arc.

2. The circuit interrupter as defined in claim 1 wherein said insulation member is formed of a non-rigid material.

3. The circuit interrupter as defined in claim 1 wherein said slot motor housing is formed of cellulose filled Melamine Formaldehyde.

4. The circuit interrupter as defined in claim 1 wherein said slot motor housing includes a barrier portion positioned adjacent said magnetic member and outside of said opening region.

5. The circuit interrupter as defined in claim 1 wherein said insulation member is comprised of adhesive tape formed of glass-cloth-woven and silicon-resin-treated material.

6. The circuit interrupter as defined in claim 1 wherein said insulation member includes a flap portion positioned adjacent said magnetic member but not between said magnetic plates and said slot motor housing.

7. The circuit interrupter as defined in claim 1 wherein said insulation member is arc-resistant.

8. The circuit interrupter as defined in claim 1 wherein said slot motor assembly is substantially U-shaped.

9. The circuit interrupter as defined in claim 8 wherein said slot motor housing and said magnetic member are substantially U-shaped.

10. A circuit interrupter comprising:

a housing;

separable main contacts within said housing;

an operating mechanism within said housing and interconnected with said separable main contacts;

an arc extinguisher assembly within said housing; and a slot motor assembly means positioned within said housing and having an opening region in which said separable main contacts are substantially located, said slot motor assembly means electro-magnetically interacting with current flowing between said contacts, said slot motor assembly means including a magnetic means and a slot motor housing means, said slot motor housing means positioned between said magnetic means and said opening region, said slot motor housing means formed of a material that evolves gas upon exposure to an arc to assist in dissipation of said arc by said arc extinguisher assembly, said slot motor assembly means also including an insulation means positioned between said magnetic means and said slot motor housing means, said insulation means formed of a material that does not substantially evolve gas upon exposure to an arc.

11. The circuit interrupter as defined in claim 1 wherein said insulation member is formed of a material that is substantially gas impervious.

12. The circuit interrupter as defined in claim 1 wherein said magnetic member is comprised of a plurality of magnetic plates.

13. A circuit interrupter comprising:

a housing;

separable main contacts within said housing;

an operating mechanism within said housing and interconnected with said separable main contacts;

an arc extinguisher assembly within said housing; and a slot motor assembly positioned within said housing and having an opening region in which said separable main contacts are substantially located, said slot motor assembly electro-magnetically interacting with current flowing between said contacts, said slot motor assembly including a magnetic member and a slot motor housing, said slot motor housing positioned between said magnetic member and said opening region, said slot motor housing formed of a material that evolves gas upon exposure to an arc to assist in dissipation of said arc by said arc extinguisher assembly, said slot motor assembly also including an insulation member positioned between said magnetic member and said slot motor housing, said insulation member formed of a material that is substantially arc-resistant.

* * * * *